US009849574B2

(12) United States Patent
Hecht et al.

(10) Patent No.: US 9,849,574 B2
(45) Date of Patent: Dec. 26, 2017

(54) HAND-HELD POWER TOOL

(75) Inventors: Joachim Hecht, Magstadt (DE); Heiko Roehm, Stuttgart (DE); Martin Kraus, Filderstadt (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1123 days.

(21) Appl. No.: 13/997,305

(22) PCT Filed: Nov. 29, 2011

(86) PCT No.: PCT/EP2011/071270
§ 371 (c)(1),
(2), (4) Date: Sep. 6, 2013

(87) PCT Pub. No.: WO2012/084428
PCT Pub. Date: Jun. 28, 2012

(65) Prior Publication Data

US 2013/0333907 A1 Dec. 19, 2013

(30) Foreign Application Priority Data

Dec. 22, 2010 (DE) ..... 10 2010 063 953

(51) Int. Cl.
*B25D 16/00* (2006.01)
*B25B 23/14* (2006.01)

(52) U.S. Cl.
CPC ..... *B25D 16/006* (2013.01); *B25B 23/141* (2013.01); *B25D 2211/064* (2013.01);
(Continued)

(58) Field of Classification Search
CPC ..... B26D 16/006; B23B 45/008; B25D 2216/0023
(Continued)

(56) References Cited

U.S. PATENT DOCUMENTS 4,585,077 A * 4/1986 Bergler ..... B23B 31/1238 173/13
7,201,235 B2 * 4/2007 Umemura ..... B23B 45/008 173/104
(Continued)

FOREIGN PATENT DOCUMENTS

CN 101253027 8/2008
CN 101797744 8/2010
(Continued)

*Primary Examiner* — Gloria R Weeks
(74) *Attorney, Agent, or Firm* — Norton Rose Fulbright US LLP; Gerard Messina

(57) ABSTRACT

A hand-held power tool having hammer-drilling, drilling and screwing modes, including a mode-setting device having an actuating element, a setting element, and a gear unit for driving an output shaft, in which the actuating and setting elements are interconnected in a rotatably fixed manner, and, in an operating mode(s), the setting element is coupled to a transmission element supported at a coupling housing assigned to the gear unit and axially displaceable at the coupling housing in a screwing position associated with the screwing mode and is axially fixed in position at the coupling housing in hammer-drilling and drilling positions of the corresponding modes; the transmission element is connected to the coupling housing in a rotatably fixed manner, a predefined operating mode being settable by rotating the setting element; the setting and transmission elements being rotatable relative to one another, the setting element embracing at least sections of the transmission element.

16 Claims, 6 Drawing Sheets

(52) U.S. Cl.
CPC ..... *B25D 2216/0023* (2013.01); *B25D 2216/0038* (2013.01); *B25D 2216/0092* (2013.01); *B25D 2250/165* (2013.01)

(58) Field of Classification Search
USPC ..... 173/48
See application file for complete search history.

(56) References Cited

U.S. PATENT DOCUMENTS

| | | | | |
|---|---|---|---|---|
| 7,222,862 | B2 * | 5/2007 | Buchholz | B25D 17/08 144/136.95 |
| 7,308,948 | B2 * | 12/2007 | Furuta | B25B 21/00 173/178 |
| 7,410,007 | B2 * | 8/2008 | Chung | B25B 21/02 173/176 |
| 7,987,920 | B2 * | 8/2011 | Schroeder | B25D 16/006 173/104 |
| 8,322,457 | B2 * | 12/2012 | Mok | B23B 31/1238 173/47 |
| 8,757,285 | B2 * | 6/2014 | Weber | B24B 23/04 173/216 |
| 2006/0086514 | A1 | 4/2006 | Aeberhard | |
| 2006/0185870 | A1 * | 8/2006 | Gehret | B23B 31/123 173/217 |
| 2006/0201688 | A1 * | 9/2006 | Jenner | B25B 21/00 173/48 |
| 2006/0213675 | A1 * | 9/2006 | Whitmire | B23B 45/008 173/48 |
| 2007/0131439 | A1 * | 6/2007 | Hashimoto | B23B 31/005 173/48 |
| 2007/0163793 | A1 * | 7/2007 | Aeberhard | B25D 16/006 173/48 |
| 2009/0101376 | A1 * | 4/2009 | Walker | B25B 21/00 173/47 |
| 2013/0283729 | A1 * | 10/2013 | Outreman | B65B 51/10 53/127 |

FOREIGN PATENT DOCUMENTS

| | | |
|---|---|---|
| CN | 101959632 | 1/2011 |
| DE | 10 2004 051911 | 4/2006 |
| EP | 0 437 716 | 7/1991 |
| EP | 1 555 091 | 7/2005 |
| EP | 1 782 924 | 5/2007 |
| EP | 1 857 228 | 11/2007 |
| EP | 2 216 114 | 8/2010 |

* cited by examiner

HAND-HELD POWER TOOL

FIELD OF THE INVENTION

The present invention relates to a hand-held power tool for operation in hammer-drilling, drilling and screwing modes, which includes a mode-setting device having an actuating element and a setting element, as well as a gear unit for driving an output shaft; the actuating element and the setting element being interconnected in a rotatably fixed manner, and, at least in one operating mode, the setting element being coupled to a transmission element, which is supported at a coupling housing assigned to the gear unit and, in a screwing position associated with the screwing mode, is axially displaceable at the coupling housing and, in hammer-drilling and drilling positions associated with the hammer-drilling and drilling modes, is axially fixed at the coupling housing.

BACKGROUND INFORMATION

Such a hand-held power tool, which includes a driving device provided for driving an output shaft that has a drive unit and a gear unit coupled to the drive unit, is discussed in EP 1 555 091 A2. This hand-held power tool may be operated in different operating modes, which include a hammer-drilling, a drilling and a screwing mode. In the hammer-drilling and drilling modes, there is a rigid torque coupling between the output shaft and the driving device, whereas in the screwing mode, at most, a settable torque may be transmitted. A mode-setting device is used for setting the operating modes, the mode-setting device including a mode-setting sleeve rotatable via manual manipulation, as well as a transmission element, which is coupled to the mode-setting sleeve in a rotatably fixed manner and is supported on a coupling housing assigned to the gear unit. The mode-setting sleeve and the transmission element are supported so as to be able to rotate about the longitudinal axis of the output shaft, so that the transmission element executes corresponding rotary setting movements of the mode-setting sleeve. Consequently, each of the different operating modes is assigned a respective, predetermined rotational position of the mode-setting sleeve and the transmission element.

A disadvantage of the related art is that there is normally a predetermined axial free space between the transmission element and the mode-setting sleeve, which may increase in size over the service life of the hand-held power tool, due to abrasion. Therefore, a reliable and precise mode-setting position over a comparatively long operating period of the hand-held power tool is only achievable with difficulty.

SUMMARY OF THE INVENTION

Therefore, an object of the present invention is to provide a new hand-held power tool for operation in hammer-drilling, drilling and screwing modes, where the operating modes of the hand-held power tool are also reliably settable over a long period of operation.

This object may be achieved by a hand-held power tool for operation in hammer-drilling, drilling and screwing modes, the hand-held power tool including a mode-setting device having an actuating element and a setting element, as well as a gear unit for driving an output shaft. The actuating element and the setting element are interconnected in a rotatably fixed manner, and, at least in one operating mode, the setting element is coupled to a transmission element, which is supported at a coupling housing assigned to the gear unit and, in a screwing position associated with the screwing mode, is axially displaceable at the coupling housing and, in hammer-drilling and drilling positions associated with the hammer-drilling and drilling modes, is axially fixed at the coupling housing. The transmission element is connected to the coupling housing in a rotatably fixed manner, and a predefined operating mode may be set by rotating the setting element. The setting element and transmission element may rotate relative to one another, and the setting element embraces the transmission element at least sectionally.

Thus, the present invention allows a hand-held power tool to be provided, which may be produced with a reduced size and a reduced number of component parts and has a robust and reliable mode-setting device, via which different operating modes may be reliably set over a long operating period.

According to one specific embodiment, the transmission element is formed in the shape of a disk.

This may allow a sturdy and compact mode-setting device to be provided.

The transmission element may include fixing elements, by which the transmission element is fixed in position at the coupling housing in a rotatably fixed manner.

Consequently, the transmission element may be safely and reliably locked in position at the coupling housing in a rotatably fixed manner.

The fixing elements may have extensions, which are directed radially outwards, and by which the transmission element is fixed axially in position at the coupling housing in the hammer-drilling and drilling modes.

Therefore, in the hammer-drilling and drilling modes, the transmission element may be axially fixed in position at the coupling housing in a simple manner.

According to one specific embodiment, the setting element is fixed in position at the coupling housing so as to be essentially immovable in the axial direction.

Thus, the present invention allows a hand-held power tool having a compact design and a comparatively reduced overall length to be provided.

The setting element may be formed in the shape of a sleeve.

This allows a simple and inexpensive setting element to be provided.

According to one specific embodiment, the setting element includes fastening elements, which are configured to permit or prevent the axial displaceability of the transmission element at the coupling housing.

Thus, the present invention allows a mode-setting device produced using a reduced number of component parts to be provided.

The fastening elements may include retaining elements, which are configured to axially fix the setting element in position at the coupling housing.

Consequently, the setting element may be axially fixed in position at the coupling housing in a simple manner.

The fastening elements may include blocking elements, by which, in the hammer-drilling and drilling modes, the transmission element is axially fixed in the corresponding hammer-drilling or drilling position at the coupling housing; in the screwing mode, the blocking elements releasing the transmission element in the axial direction.

Therefore, the axial displaceability of the transmission element at the coupling housing may be allowed or prevented safely and reliably.

According to one specific embodiment, force-transmission elements for axially transmitting force from the setting element to the coupling housing in at least one operating mode are provided at the coupling housing.

Consequently, the present invention allows a mode-setting device to be provided, in which a displacement may be limited or a force introduced via the output shaft may be received by the setting element.

According to one specific embodiment, the output shaft is assigned a stop mechanism for producing percussion in the hammer-drilling mode, and the setting element has deactivation elements for deactivating the stop mechanism.

Consequently, the present invention allows a single setting element to be provided, by which both deactivation of a torque coupling assigned to the hand-held power tool and deactivation of a locking mechanism assigned to the hand-held power tool may be carried out safely and reliably.

The setting element may be connected to the coupling housing by a bayonet joint.

This allows sturdy and robust attachment of the setting element to the coupling housing.

The actuating element may be formed in the manner of an actuating sleeve rotatable via manual manipulation.

Thus, a simple and reliable actuating element may be provided.

According to one specific embodiment, the setting element and the actuating element are formed in one piece.

This allows a robust and inexpensive, combined setting and actuating element to be provided.

According to one specific embodiment, at least one spring element is provided, which is configured to axially apply a predefined spring force to the transmission element in the direction of the hammer-drilling and drilling positions. The predefined spring force may be adjustable within specified limits by a corresponding torque setting device.

Therefore, the present invention allows a safe and reliable torque coupling to be provided.

The present invention is explained in further detail in the following description, on the basis of exemplary embodiments illustrated in the drawings.

DETAILED DESCRIPTION

Figure 1:
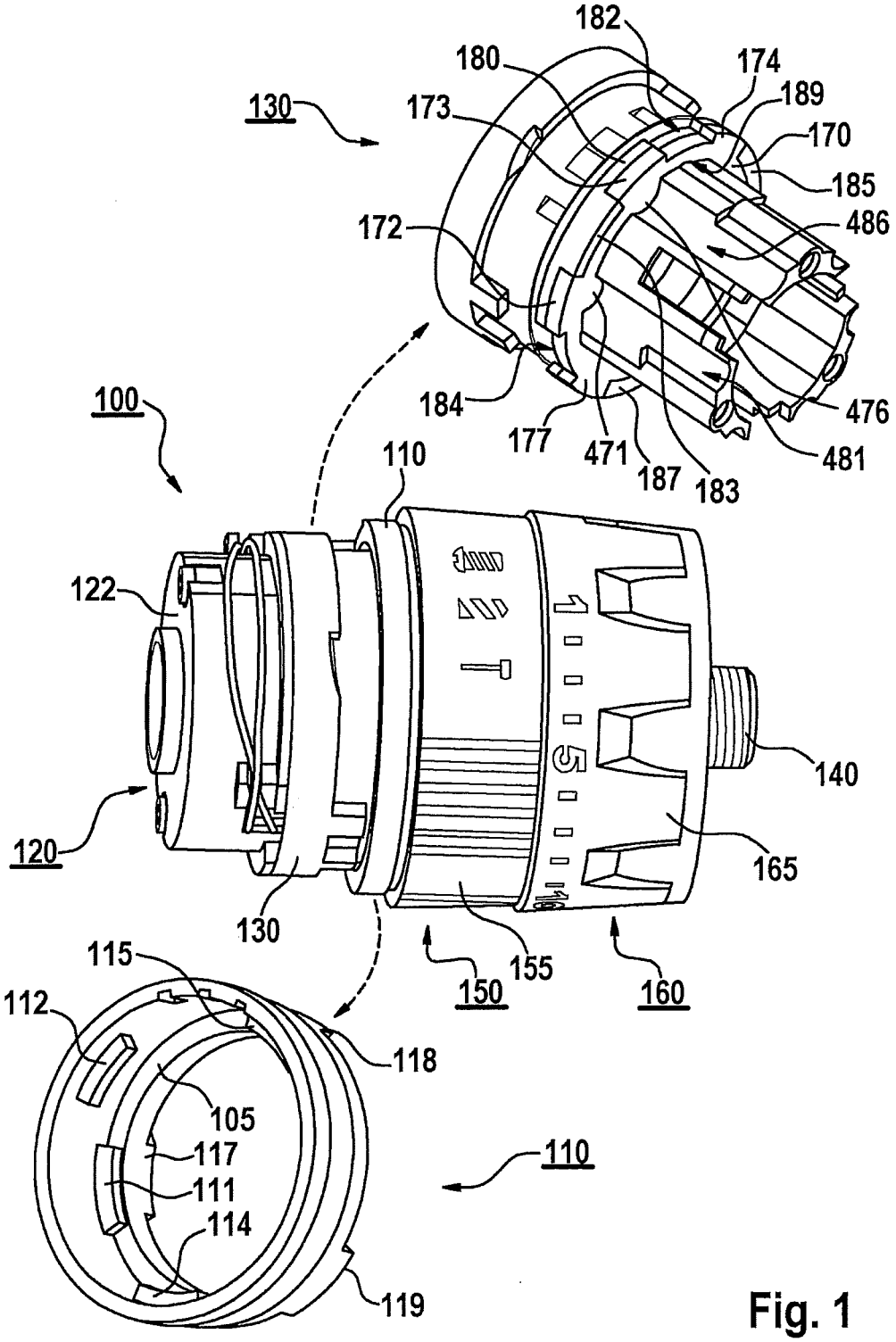
FIG. 1 shows a perspective view of a detail of a hand-held power tool, including a gear unit, a mode-setting device, as well as a torque-setting device according to the present invention.

FIG. 1 shows a hand-held power tool 100 for operation in hammer-drilling, drilling and screwing modes in accordance with the present invention. To simplify the drawing, hand-held power tool 100 is only illustrated sectionally, in light of a gear unit 120, a mode-setting device 150 having a setting element 110, a torque-setting device 160, as well as an output shaft 140.

According to one specific embodiment, hand-held power tool 100 has a driving device, e.g., an electric drive motor, for driving gear unit 120. An angular motion of the drive motor is transmitted to output shaft 140, which is illustratively formed in the manner of a tool spindle, and to which, e.g., a chuck may be attached for receiving an insertable tool. Gear unit 120 is situated, for example, in a gear housing 122, which is connected to a coupling housing 130 and may form coupling housing 130 at least in sections.

For purposes of illustration, coupling housing 130 is formed in the shape of a sleeve and has, at its circumference, an annular collar 180, which takes the form of a retaining element that is at least sectionally formed in the shape of a shoulder. Annular collar 180 is provided, for example, with discontinuities 182, 184, 186 (FIGS. 4 through 6) and has force transmission elements 183, 185, 187, which are formed, for example, in the manner of axially oriented extensions on annular collar 180 and are used for axially transmitting force from setting element 110 to coupling housing 130 in at least one operating mode. According to one specific embodiment, on its side facing away from gear housing 122, annular collar 180 forms an annular support surface 189 for a transmission element 170, the annular support surface being formed in the shape of a groove in the region of force transmission elements 183, 185, 187. In addition, e.g., axially oriented grooves 481, 486, as well as 482-485 (FIGS. 4 to 6), are provided at coupling housing 130.

According to one specific embodiment, transmission element 170 is formed to be disk-shaped, in the manner of a pressure plate or a thrust ring, and therefore, it is referred to as such in the following. As illustrated, thrust ring 170 has fixing elements 177, 172, 173, 174, as well as 175-176 (FIGS. 4 and 5) and 471, 476 and 472-475, by which thrust ring 170 is fixed in position at coupling housing 130 in a rotatably fixed manner. These have, for example, projections 177, 172, 173, 174 and 175-176 (FIGS. 4 and 5) directed radially outwards and bulbous extensions 471, 476 and 472-475 (FIGS. 4 through 6) directed radially inwards. The extensions 471, 476 and 472-475 (FIGS. 4 through 6) directed radially inwards are situated in axially oriented grooves 481, 486 and 482-485 (FIGS. 4 through 6) of coupling housing 130. In each instance, the projections 177, 172, 173, 174 and 175-176 (FIGS. 4 and 5) directed radially outwards embrace, in pairs, a corresponding force transmission element 183, 185, 187 of coupling housing 130. For example, projections 172, 173 embrace force transmission element 183. In addition, in the hammer-drilling and drilling modes, the projections 177, 172, 173, 174 and 175-176 (FIGS. 4 and 5) directed radially outwards are configured to allow thrust ring 170 to be axially fixed in position at coupling housing 130, as described below. In the screwing mode, thrust ring 170 may execute an axial positioning movement with respect to coupling housing 130 and setting element 110, as described below with regard to FIGS. 4 through 6.

As illustrated, mode-setting device 150 has, for example, a sleeve-shaped actuating element 155 that is, therefore, also referred to below as an actuating sleeve or mode-setting sleeve, as well as the setting element 110, which is connected to it in a rotatably fixed manner and, as illustrated, is also sleeve-shaped and also referred to in the following as a switching sleeve. An example of the attachment of actuating sleeve 155 to switching sleeve 110 via radial extensions (491, 493, 495 in FIGS. 4 through 6) provided on switching sleeve 110 is described with reference to FIGS. 4 through 6. Actuating sleeve 155 is supported at coupling housing 130 via switching sleeve 110, so as to be able to rotate about the longitudinal axis of output shaft 140. The operating modes of hammer-drilling, drilling and screwing may be set by appropriately rotating actuating sleeve 155 and, consequently, switching sleeve 110.

Figure 4A:
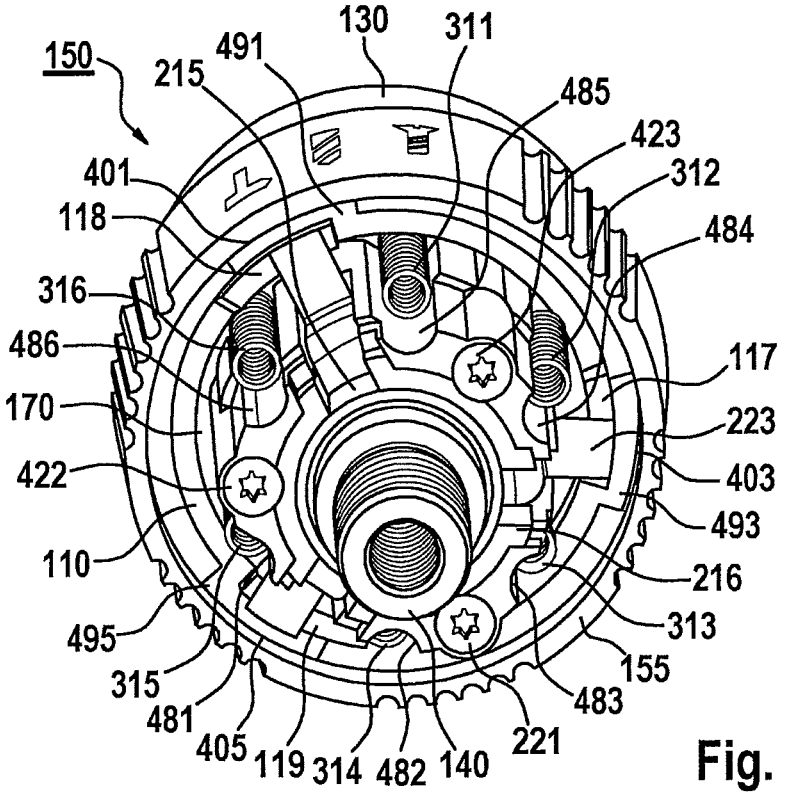
FIG. 4 shows a simplified perspective view and a sectional view of the detail of the hand-held power tool of FIG. 1 in the screwing mode.
Figure 4B:
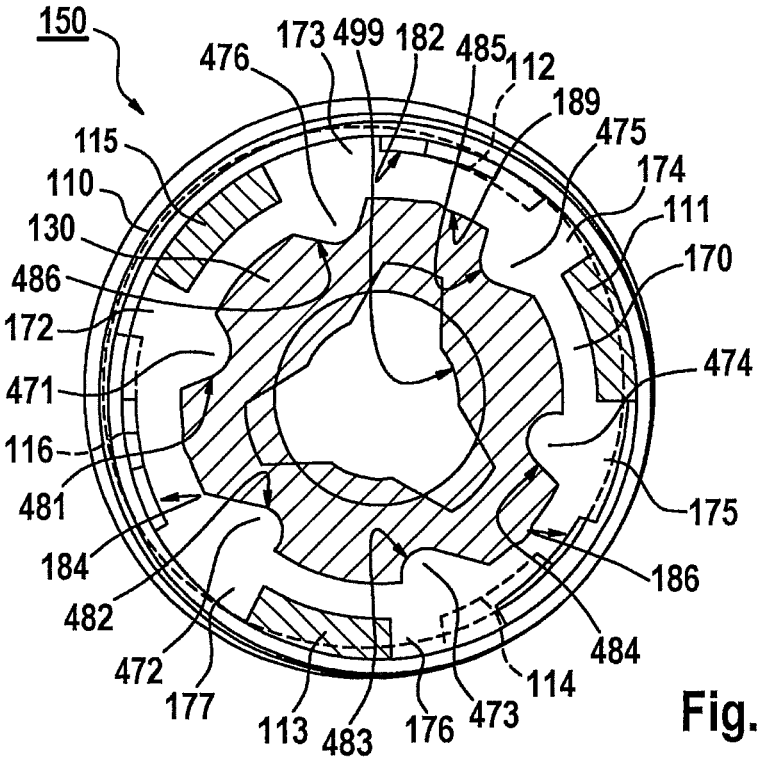
Figure 5A:
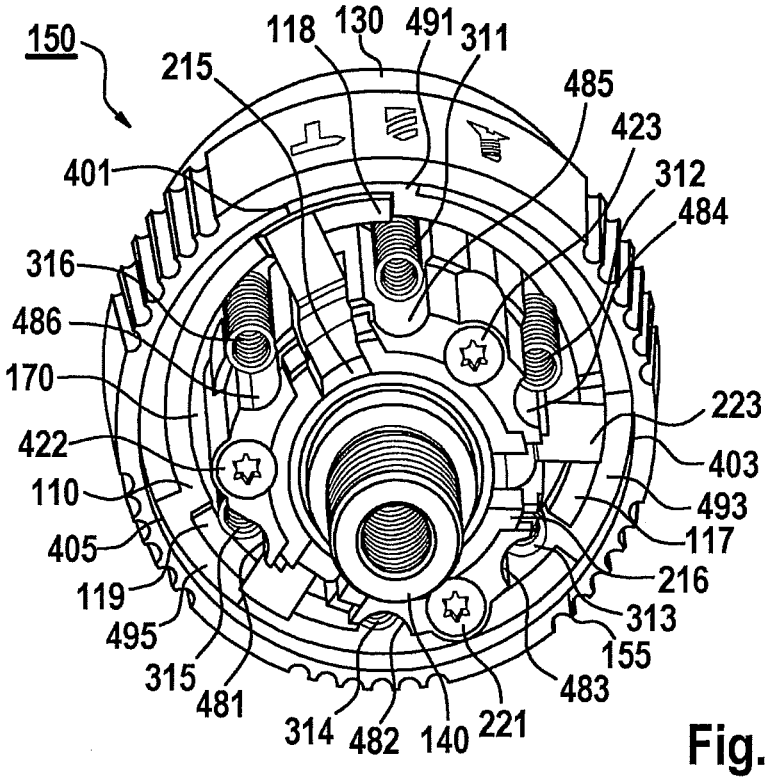
FIG. 5 shows a simplified perspective view and a sectional view of the detail of the hand-held power tool of FIG. 1 in the drilling mode.
Figure 5B:
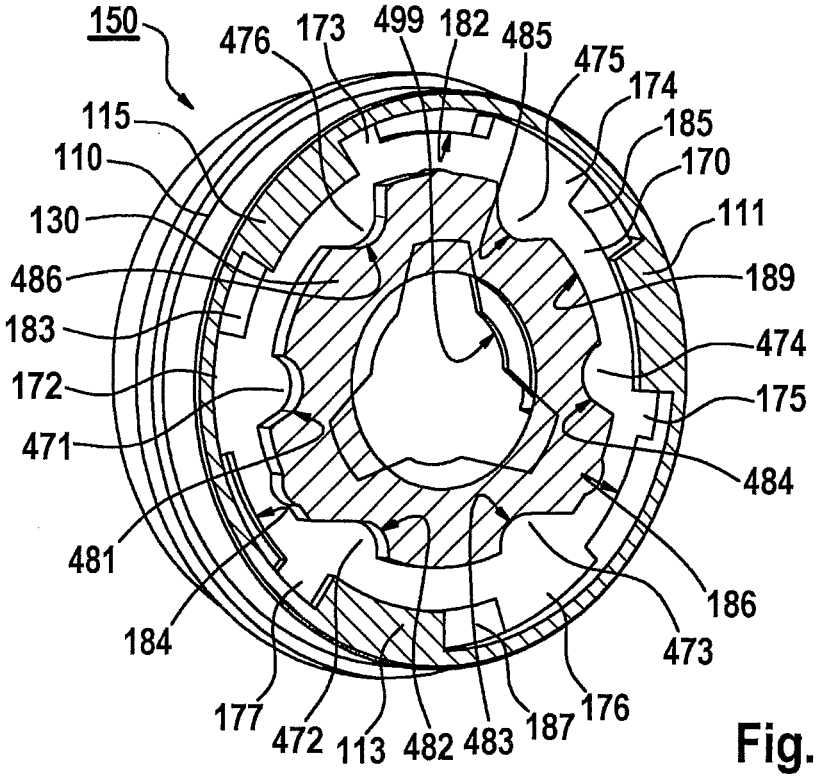
Figure 6A:
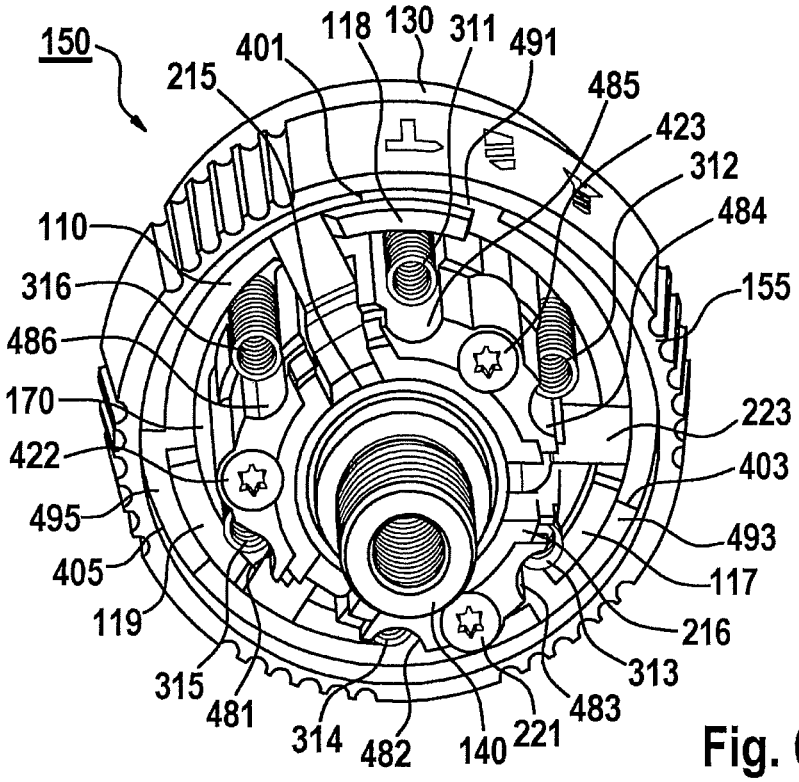
FIG. 6 shows a simplified perspective view and a sectional view of the detail of the hand-held power tool of FIG. 1 in the hammer-drilling mode.
Figure 6B:
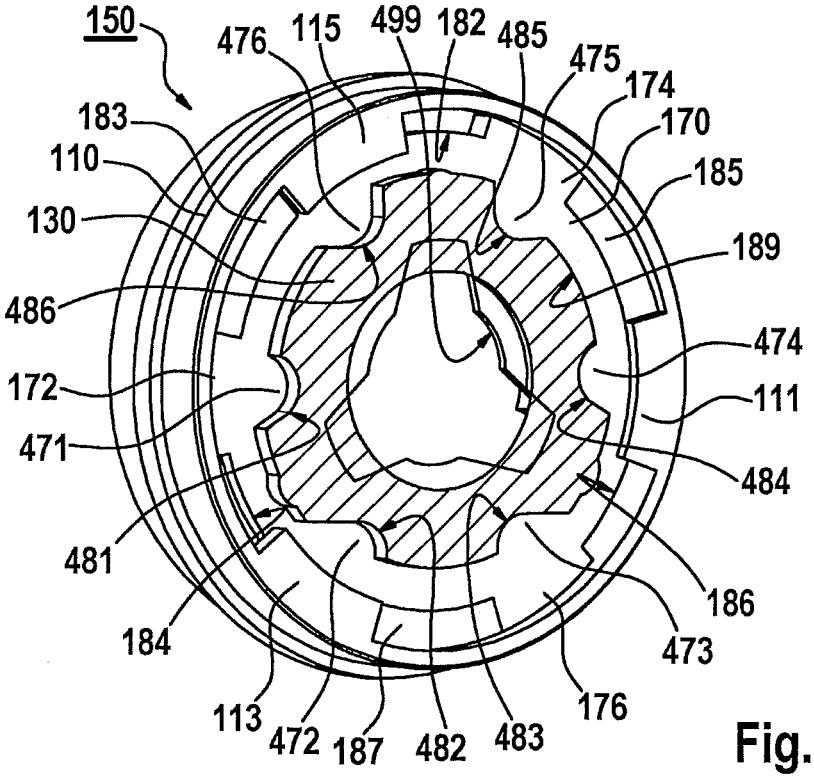

Switching sleeve 110 is essentially fixed in position at coupling housing 130, in the axial direction of output shaft 140. However, for tolerance reasons, axial play may be advantageous for seating on actuating sleeve 155. According to one specific embodiment, switching sleeve 110 has fastening elements 111, 112, 113, (FIGS. 4 and 6), 114, 115, 116, which are configured to allow or prevent the axial displaceability of thrust ring 170 at coupling housing 130. As illustrated, these fastening elements 111, 112, 113 (FIGS. 4 and 6) 114, 115, 116 have rib-like retaining elements 112, 114, 116 directed radially inwards, which are also referred to in the following as retaining ribs, as well as rib-like blocking elements 111, 115 and 113 (FIGS. 4 through 6), which are also referred to in the following as blocking ribs. As illustrated, blocking ribs 111, 115 and 113 (FIGS. 4 through 6) are formed with an axial orientation, at a circumferential collar 105, which is provided at an inner circumference of switching sleeve 110 and is directed radially inwards. As an alternative to this, blocking ribs 111, 115 and 113 (FIGS. 4 through 6) may be implemented as projections that are formed at the inner circumference of switching sleeve 110 and are directed radially inwards. As described with regard to FIGS. 5 and 6, in the hammer-drilling and drilling modes, thrust ring 170 is axially locked in a corresponding hammer-drilling or drilling position at coupling housing 130, by blocking ribs 111, 115 and 113 (FIGS. 4 through 6). In the screwing mode, blocking ribs 111, 115 and 113 release thrust ring 170 in the axial direction, as described in FIG. 4. In addition, as illustrated, switching sleeve 110 has rib-like deactivation elements 117, 118, 119, which are formed on an end face of switching sleeve 110 and form a positioning contour, as described below in regard to FIG. 2.

When switching sleeve 110 is mounted on coupling housing 130, switching sleeve 110 is slid onto coupling housing 130 in such a manner, that retaining ribs 112, 114, 116 initially reach through discontinuities 182, 184 and 186 (FIG. 4) at the outer surface of thrust ring 170. Switching sleeve 110 is then rotated clockwise, for example, so that retaining ribs 112, 114, 116 reach behind annular collar 180 and, consequently, together with blocking ribs 111, 115 and 113 (FIGS. 4 through 6), axially fix switching sleeve 110 in position at annular collar 180 in the manner of a bayonet joint. In addition, a locking element, which allows switching sleeve 110 to be locked into assigned rotational positions at coupling housing 130, is situated between switching sleeve 110 and coupling housing 130; these rotational positions being associated with the different operating modes of hand-held power tool 110. However, it should be pointed out that suitable locking elements are sufficiently well-known to one skilled in the art, e.g., locating springs, so that for reasons of conciseness of the specification, a detailed description of a specific locking element is omitted, here.

As illustrated, torque-setting device 160 has a torque-setting sleeve 165, which is positioned after actuating or mode-setting sleeve 155 in the axial direction of output shaft 140 and may be actuated independently of it, i.e., may be rotated about the longitudinal axis of output shaft 140. Using torque-setting sleeve 165, the maximum transmittable torque of hand-held power tool 100 in the screwing mode may be set.

Figure 2:
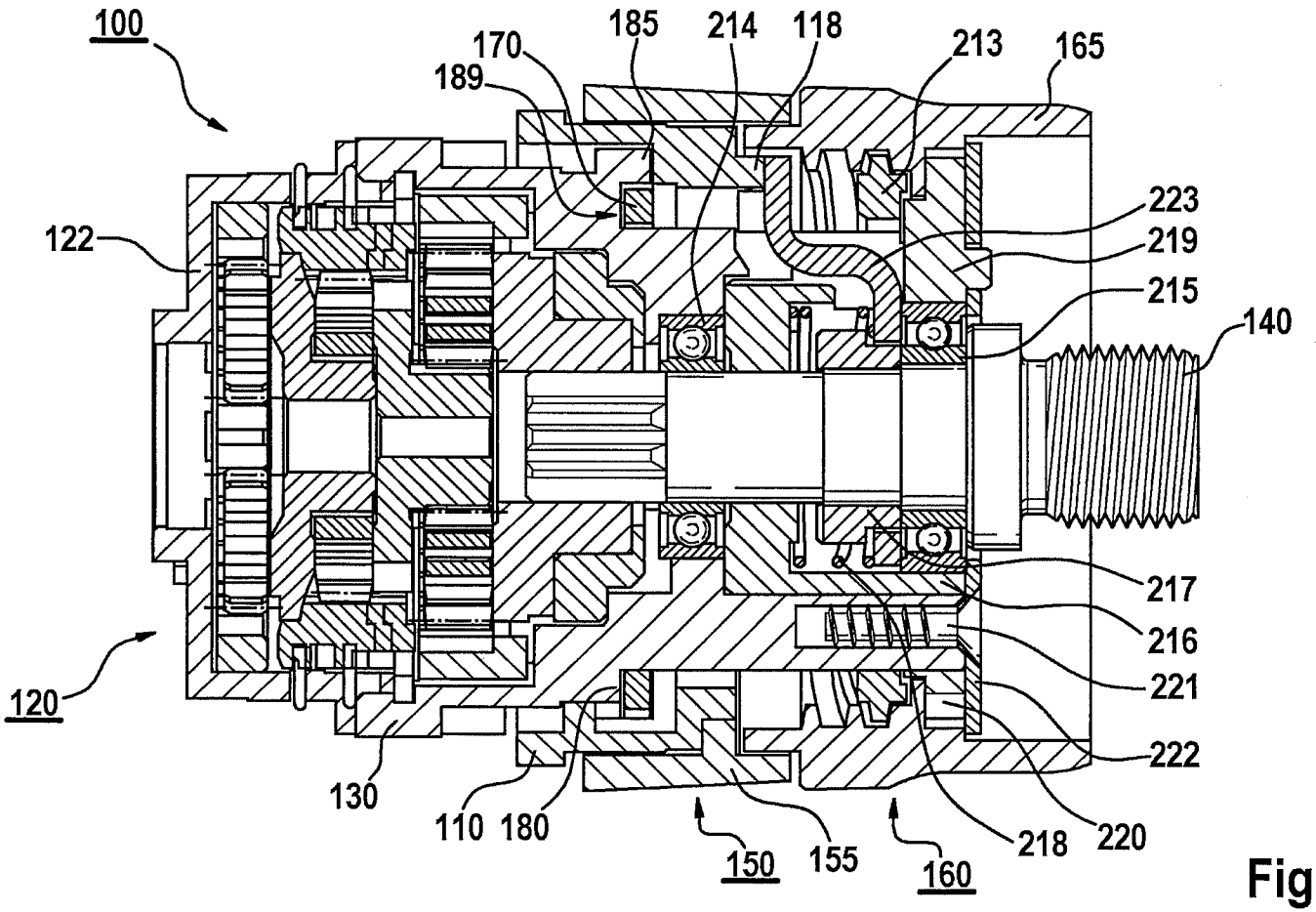
FIG. 2 shows a first sectional view of the detail of the hand-held power tool of FIG. 1.

FIG. 2 shows a sectional view of the detail of hand-held power tool 100 of FIG. 1, including gear unit 120, mode-setting device 150, torque-setting device 160 and output shaft 140, where the cut is made approximately perpendicular to the plane of the paper. Gear unit 120 takes the form, for example, of planetary gearing including three planet stages. Since the basic design and the method of functioning of planetary gears is sufficiently well-known to one skilled in the art, a detailed description is omitted here for the sake of simplicity of the specification.

According to one specific embodiment, torque-setting sleeve 165 of torque-setting device 160 is axially fixed in position at coupling housing 130, and its internal thread engages with the external thread of a spring retaining ring 213, which is seated on coupling housing 130 in a rotatably fixed, but axially movable manner. This is accomplished, for example, with the aid of screws 221 and 422, 423 (FIGS. 4 through 6), which connect a retaining plate 222 to coupling housing 130. Plate 222 encompasses output shaft 140 and pushes a locating spring retainer 219 against an annular shoulder in torque-setting device 165, so that in this manner, torque-setting device 165 is also axially secured at coupling housing 130. In order that torque-setting sleeve 165 locks into discrete locking positions in response to being rotated for setting a maximum transmittable torque, a locating spring element 220, which is supported at locating spring retainer 219, applies a force to the torque-setting sleeve; locating spring retainer 219 and locating spring element 220 being situated in the interior space encompassed by torque-setting sleeve 165. Locating spring element 220 locks in discrete angular positions, for example, by acting upon a locking contour at the inner side of torque-setting sleeve 165.

As illustrated, output shaft 140 is supported by two axially spaced ball bearings 214, 215 so as to be able to rotate with respect to coupling housing 130 and gear housing 122. In addition to the angular motion, output shaft 140 may also execute an axial positioning movement with respect to coupling housing 130. To this end, second ball bearing 215 is connected to output shaft 140 in an axially rigid manner and is supported inside of a locking jar 216 so as to be able to slide. First ball bearing 214 is positioned in coupling housing 130 so as to be attached to it. The axial positioning movement allows output shaft 140 to be moved between the hammer-drilling position and the drilling and screwing positions. In the hammer-drilling position, output shaft 140, in FIG. 2, may be moved to the left, i.e., into coupling housing 130. In this connection, locking jar 216 enters into locking engagement with locking disk 217, which is seated on the surface of output shaft 140 in a rotatably fixed manner and forms a locking mechanism together with locking jar 216. Locking disk 217 additionally has the task of axially fixing ball bearing 215 on output shaft 140, the ball bearing also being seated on the surface of the output shaft. A spring element 218 is situated inside of locking jar 216, the spring element forcing output shaft 140, via a locking part 223 and ball bearing 215, into an assigned, outer locking position, in which locking jar 216 and locking disk 217 are not in engagement.

One axial end of locking part 223 rests on switching sleeve 110, and its other axial end rests on an outer ring assigned to ball bearing 215. Switching sleeve 110 wraps around at least sections of the thrust ring 170, which is illustratively situated in the interior of switching sleeve 110 and is directly supported on the support surface 189 formed at coupling housing 130. Locking part 223 is used for making contact with the positioning contour formed on the end face of switching sleeve 110 by deactivation ribs 118 and 117, 119 (FIG. 1), as well as for transmitting it to ball bearing 215, and consequently, to locking disk 217. In this connection, predefined axial changes in elevation in the positioning contour at switching sleeve 110, which are caused by deactivation ribs 118 and 117, 119, are transmitted to locking disk 217 via contact with locking part 223, so that locking disk 217 experiences a corresponding axial change in position. In this manner, the locking engagement between locking disk 217 and locking jar 216 may be controlled. As illustrated, locking part 223 rests on deactivation ribs 118 and 117, 119 (FIG. 1), so that locking disk 217 is axially set apart from the bottom of locking jar 216, and consequently, the locking mechanism of hand-held power tool 100 is deactivated. This deactivation is carried out in the screwing mode (FIG. 4) and in the drilling mode (FIG. 5). In the hammer-drilling mode (FIG. 6), locking part 223 does not rest on deactivation ribs 118 and 117, 119 (FIG. 1), which means that locking disk 217 and locking jar 216 may enter into locking engagement, as described above.

Figure 3:
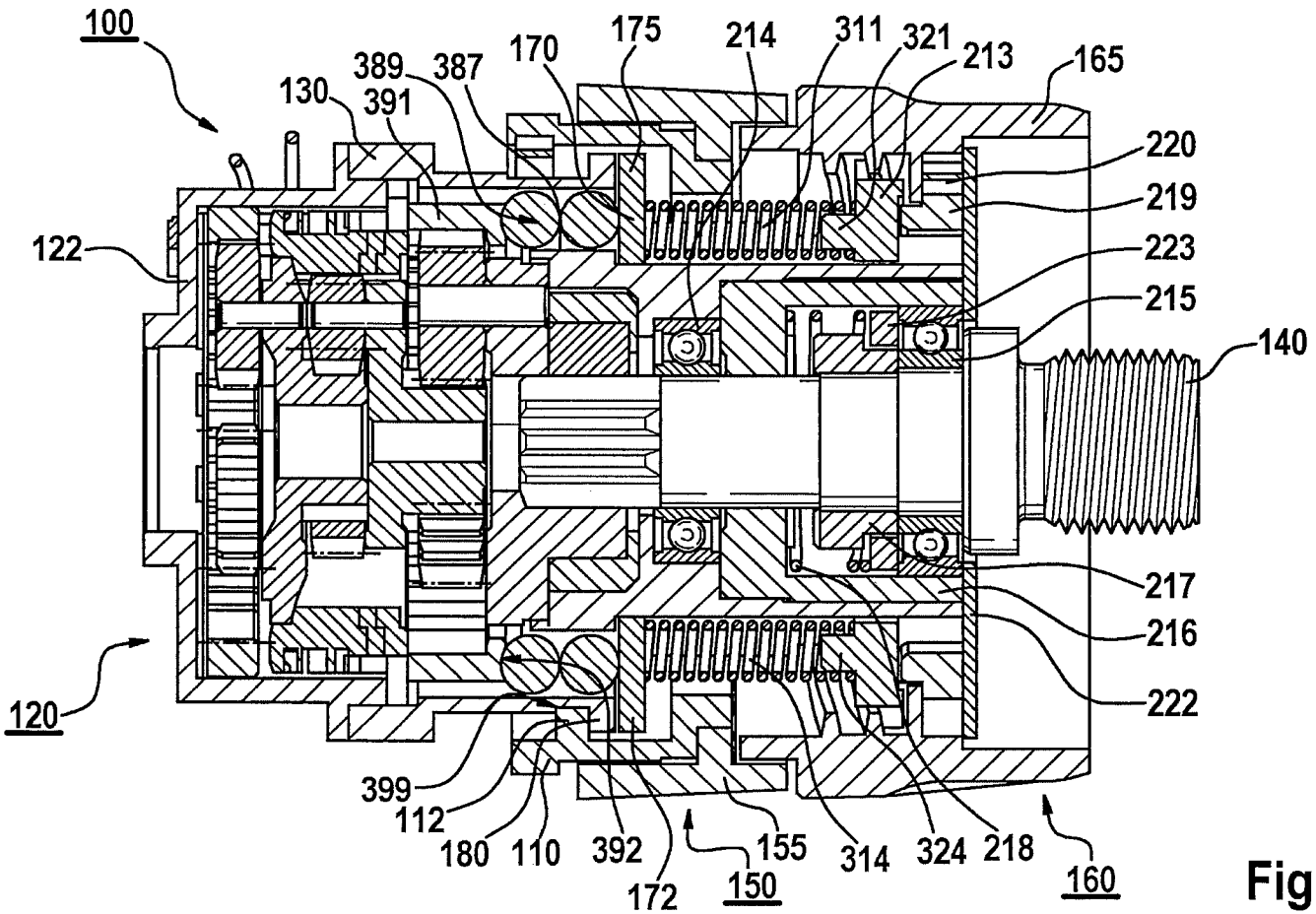
FIG. 3 shows a second sectional view of the detail of the hand-held power tool of FIG. 1.

FIG. 3 shows a sectional view of the detail of hand-held power tool 100 of FIG. 1, including gear unit 120, mode-setting device 150, torque-setting device 160 and output shaft 140, where the cut is made approximately in the plane of the paper in FIG. 1. FIG. 3 illustrates an exemplary embodiment of the switching sleeve 110 connected to coupling housing 130 by a bayonet joint, as described with regard to FIG. 1; as illustrated, the retaining rib 112 directed radially inwards engaging with an annular groove 399, which is provided in the region of annular collar 180 of coupling housing 130. In addition, the projection 172 directed radially outwards, as well as a further projection 175 of thrust ring 170 directed radially outwards, is shown in FIG. 3.

According to one specific embodiment, hand-held power tool 100 has a spring device, which is formed by spring retaining ring 213 and several spring elements 311, 314 and 312, 313, 315, 316 (FIGS. 4 through 6) and is configured to set a maximum transmittable torque in the screwing mode of hand-held power tool 100. Spring elements 311, 314 and 312, 313, 315, 316 (FIGS. 4 through 6) are positioned at coupling housing 130 so as to be distributed over the circumference, and take the form of, for example, helical compression springs. As illustrated, spring elements 311, 314 and 312, 313, 315, 316 (FIGS. 4 through 6) extend between spring retaining ring 213 and thrust ring 170. As illustrated, six studs, onto which spring elements 311, 314 and 312, 313, 315, 316 (FIGS. 4 through 6) may be slipped, are situated on spring retaining ring 213. As illustrated, only two studs, which are indicated by reference numerals 321, 324, and onto which spring elements 311 and 314, respectively, are slipped, are visible in FIG. 3.

Spring retaining ring 213 is, for example, axially displaceable relative to output shaft 140, and in the event of a rotational movement of torque-setting sleeve 165, it moves axially relative to output shaft 140, due to the threaded connection with torque-setting sleeve 165, which means that the initial stress of spring elements 311, 314 and 312, 313, 315, 316 (FIGS. 4 through 6), which push thrust ring 170 against coupling housing 130 with an axial force corresponding to the initial stress, changes. Consequently, with increasing initial stress of spring elements 314 and 312, 313, 315, 316 (FIGS. 4 through 6), the axial force, which is exerted by them on the thrust ring 170, increases.

According to one specific embodiment, spring retaining ring 213, spring elements 311, 314 and 312, 313, 315, 316 (FIGS. 4 through 6) and thrust ring 170 form a torque coupling together with several balls 389 and a locking disk 391, which is assigned to planetary gearing 120 and forms, as illustrated, a ring gear of a planet stage of planetary gearing 120. As illustrated, balls 389 are supported in assigned openings 387 at coupling housing 130, and in the axial direction of output shaft 140, they are situated between an end face of locking disk 391, at which a coupling structure 392 is formed, and thrust ring 170. A suitable coupling structure may have, for example, a plurality of axial projections and is sufficiently well-known to one skilled in the art, so that in this case, a detailed description of coupling structure 392 is omitted for the sake of conciseness of the specification. In addition, the method of functioning of a suitable torque coupling is sufficiently well-known to one skilled in the art, so that in this case, a detailed description is also omitted for the sake of conciseness of the specification.

FIG. 4 shows a perspective top view of the output shaft 140 of FIGS. 1 through 3 that is rotationally mounted in the coupling housing 130 of FIGS. 1 through 3, along with the mode-setting device 150 of FIGS. 1 to 3, for illustrating the setting of mode-setting device 150 for operation of hand-held power tool 100 of FIGS. 1 through 3 in the screwing mode. In this screwing mode, actuating sleeve 155 and, along with it, switching sleeve 110 are rotated into a predefined screwing position. To simplify the view, an illustration of the torque-setting device 160 of FIGS. 1 through 3 was omitted in FIG. 4.

In addition, a sectional view of coupling housing 130, switching sleeve 110 and thrust ring 170 of FIGS. 1 through 3 is shown in FIG. 4, the sectional view being cut in the region of blocking ribs 111, 113, 115 of switching sleeve 110, in order to illustrate the interaction of these component parts in the screwing mode. As illustrated, coupling housing 130 has an approximately central opening 499 for guiding output shaft 140 through.

FIG. 4 illustrates the locking part 223 resting on deactivation ribs 117, 118, 119 of switching sleeve 110 in the screwing mode, as described in FIG. 2, as well as screws 221, 422, 423, which are, for example, screwed down on coupling housing 130. In addition, FIG. 4 illustrates an exemplary, rotatably fixed connection of switching sleeve 110 to actuating sleeve 155 via radial extensions 491, 493, 495, which are provided at the circumference of switching sleeve 110 and, as illustrated, engage with corresponding recesses 401, 403, 405 provided at the inner circumference of actuating sleeve 155. However, it should be pointed out that other rotatably fixed connections between switching sleeve 110 and actuating sleeve 155 are also feasible. For example, one or more projections, which are directed radially inwards and engage with corresponding radial recesses or openings of switching sleeve 110, may be formed at the inner circumference of actuating sleeve 155.

According to one specific embodiment, in the screwing mode, at least sections of retaining ribs 112, 114, 116 of switching sleeve 110 are situated behind annular collar 180 of FIG. 1, and their blocking ribs 111, 113, 115 are situated between respective, corresponding projections 174, 175 and 176, 177 and 172, 173, directed radially outwards. Consequently, blocking ribs 111, 113, 115 rest against force transmission elements 185, 187 and 183 of coupling housing 130 and release thrust ring 170 in the axial direction. Therefore, it may be axially displaced relative to coupling housing 130 by balls 389 from FIG. 3, in opposition to the force of spring elements 311, 312, 313, 314, 315, 316, where the extensions 471, 472, 473, 474, 475, 476 of the thrust ring directed radially inwards slide in axially oriented grooves 481, 482, 483, 484, 485 and 486, respectively, of coupling housing 130.

FIG. 5 shows the perspective top view and the sectional view of FIG. 4, in which, in order to set mode-setting device 150 for operation of hand-held power tool 100 of FIGS. 1 to 3 in the drilling mode, actuating sleeve 155, and along with it, switching sleeve 110, were rotated by a predefined angle, e.g., clockwise in FIG. 5, into an assigned drilling position. In the drilling mode, locking part 223 also rests on deactivation ribs 117, 118, 119 of switching sleeve 110, as described in reference to FIG. 2.

According to one specific embodiment, in drilling mode, at least sections of retaining ribs 112, 114, 116 of switching sleeve 110 are situated behind annular collar 180 of FIG. 1 in the line of sight given in FIG. 5, and their blocking ribs 111, 113, 115 block projections of the thrust ring directed radially outwards, that is, projections 175, 177 and 173. Thus, in drilling mode, thrust ring 170 is axially fixed in position by blocking ribs 111, 113, 115 of switching sleeve 110 in the axial direction of output shaft 140 and is, accordingly, not axially displaceable. Consequently, the torque coupling is deactivated.

FIG. 6 shows the perspective top view and the sectional view of FIGS. 4 and 5, in which, in order to set mode-setting device 150 for operation of hand-held power tool 100 of FIGS. 1 to 3 in the hammer-drilling mode, actuating sleeve 155, and along with it, switching sleeve 110, were rotated by a predefined angle, e.g., clockwise in FIG. 6, into an assigned hammer-drilling position. In the hammer-drilling mode, locking part 223 does not rest on deactivation ribs 117, 118, 119 of switching sleeve 110, as described in the context of FIG. 2.

According to one specific embodiment, in the hammer-drilling mode, at least sections of retaining ribs 112, 114, 116 of switching sleeve 110 are situated behind annular collar 180 of FIG. 1 in the line of sight given in FIG. 6, and their blocking ribs 111, 113, 115 block projections of the thrust ring directed radially outwards, that is, projections 175, 177 and 173 of FIGS. 4 and 5. Thus, in hammer-drilling mode, thrust ring 170 is axially fixed in position by blocking ribs 111, 113, 115 of switching sleeve 110, in the axial direction of output shaft 140, and is, accordingly, not axially displaceable.

What is claimed is:

1. A hand-held power tool for operation in hammer-drilling, drilling and screwing modes, comprising:

a mode-setting device having an actuating element and a setting element, and a gear unit for driving an output shaft;

wherein the actuating element and the setting element are interconnected in a rotatably fixed manner, and, at least in one operating mode, the setting element is coupled to a transmission element, which is supported at a coupling housing assigned to the gear unit, and, in a screwing position associated with the screwing mode, is axially displaceable at the coupling housing, and, in hammer-drilling and drilling positions associated with the hammer-drilling and drilling modes, is axially fixed in position at the coupling housing, wherein the transmission element is connected to the coupling housing in a rotatably fixed manner, and a predefined operating mode is settable by rotating the setting element, and wherein the setting element and the transmission element is rotatable relative to one another, and the setting element embraces at least sections of the transmission element, wherein the setting element is axially fixed in position at the coupling housing, wherein the output shaft is assigned a locking mechanism for generating percussion in the hammer-drilling mode, and the setting element includes deactivation elements for deactivating the locking mechanism, wherein the deactivation elements are disposed on an end face of the setting element and protrude axially from the end face to form a positioning contour.

2. The hand-held power tool of claim 1, wherein the transmission element is formed in the shape of a disk.

3. The hand-held power tool of claim 1, wherein the transmission element has fixing elements, by which the transmission element is locked in position at the coupling housing in a rotatably fixed manner.

4. The hand-held power tool of claim 3, wherein the fixing elements have extensions directed radially outwards, by which the transmission element is axially fixed in position at the coupling housing in the hammer-drilling and drilling modes.

5. The hand-held power tool of claim 1, wherein the setting element is formed in the shape of a sleeve.

6. The hand-held power tool of claim 1, wherein the setting element has fastening elements, which are configured to allow or prevent the axial displaceability of the transmission element at the coupling housing.

7. The hand-held power tool of claim 6, wherein the fastening elements include retaining elements, which are configured to axially fix the setting element in position at the coupling housing.

8. The hand-held power tool of claim 6, wherein the fastening elements include blocking elements, by which, in the hammer-drilling and drilling modes, the transmission element is axially fixed in the corresponding hammer-drilling or drilling position at the coupling housing, and wherein in the screwing mode, the blocking elements release the transmission element in the axial direction.

9. The hand-held power tool of claim 1, further comprising:

transmission elements at the coupling housing for axial force transmission from the setting element to the coupling housing in at least one operating mode.

10. The hand-held power tool of claim 1, wherein the setting element is connected to the coupling housing by a bayonet joint.

11. The hand-held power tool of claim 1, wherein the actuating element is formed in the manner of an actuating sleeve rotatable via manual manipulation.

12. The hand-held power tool of claim 11, wherein the setting element and the actuating element are formed in one piece.

13. The hand-held power tool of claim 1, further comprising:

at least one spring element configured to push the transmission element axially in the direction of the hammer-drilling and drilling positions, using a predefined spring force.

14. The hand-held power tool of claim 13, wherein the predefined spring force is settable within predefined limits, using an assigned torque-setting device.

15. A hand-held power tool for operation in hammer-drilling, drilling and screwing modes, comprising:

a mode-setting device having an actuating element and a setting element, and a gear unit for driving an output shaft;

wherein the actuating element and the setting element are interconnected in a rotatably fixed manner, and, at least in one operating mode, the setting element is coupled to a transmission element, which is supported at a coupling housing assigned to the gear unit, and, in a screwing position associated with the screwing mode, is axially displaceable at the coupling housing, and, in hammer-drilling and drilling positions associated with the hammer-drilling and drilling modes, is axially fixed in position at the coupling housing, wherein the transmission element is connected to the coupling housing in a rotatably fixed manner, and a predefined operating mode is settable by rotating the setting element, and wherein the setting element and the transmission element is rotatable relative to one another, and the setting element embraces at least sections of the transmission element, wherein the setting element is axially fixed in position at the coupling housing, wherein the setting element has fastening elements, which are configured to allow or prevent the axial displaceability of the transmission element at the coupling housing, wherein the fastening elements include retaining elements, which are configured to axially fix the setting element in position at the coupling housing by a bayonet joint.

16. A hand-held power tool for operation in hammer-drilling, drilling and screwing modes, comprising:

a mode-setting device having an actuating element and a setting element, and a gear unit for driving an output shaft;

wherein the actuating element and the setting element are interconnected in a rotatably fixed manner, and, at least in one operating mode, the setting element is coupled to a transmission element, which is supported at a coupling housing assigned to the gear unit, and, in a screwing position associated with the screwing mode, is axially displaceable at the coupling housing, and, in hammer-drilling and drilling positions associated with the hammer-drilling and drilling modes, is axially fixed in position at the coupling housing, wherein the transmission element is connected to the coupling housing in a rotatably fixed manner, and a predefined operating mode is settable by rotating the setting element, and wherein the setting element and the transmission element is rotatable relative to one another, and the setting element embraces at least sections of the transmission element, wherein the setting element is axially fixed in position at the coupling housing, wherein the setting element has fastening elements, which are configured to allow or prevent the axial displaceability of the transmission element at the coupling housing, wherein the fastening elements include retaining elements, which are configured to axially fix the setting element in position at the coupling housing, wherein the setting element and the actuating element are formed as two separate elements.

* * * * *